US006871680B2

(12) United States Patent
Trippi, Jr.

(10) Patent No.: US 6,871,680 B2
(45) **Date of Patent: *Mar. 29, 2005**

(54) MULTI-FLOW POUR SPOUT AND ADAPTER

(75) Inventor: John Trippi, Jr., Morton Grove, IL (US)

(73) Assignee: Midwest Can Company, Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/419,442

(22) Filed: Apr. 21, 2003

(65) Prior Publication Data

US 2003/0234061 A1 Dec. 25, 2003

Related U.S. Application Data

(63) Continuation-in-part of application No. 10/075,781, filed on Feb. 14, 2002, now Pat. No. 6,598,630.

(51) Int. Cl.[7] ..... B65B 1/04

(52) U.S. Cl. ..... 141/350; 141/352; 141/302

(58) Field of Search ..... 141/2, 4, 7, 59, 141/67, 94, 192, 198, 285, 286, 290, 291, 301, 302, 351, 352, 354; 222/566, 567, 568, 569, 570, 571, 484, 514, 518, 525

(56) References Cited

U.S. PATENT DOCUMENTS

| | | | |
|---|---|---|---|
| 525,744 | A | 9/1894 | Roth |
| 530,228 | A | 12/1894 | Keiner |
| 539,422 | A | 5/1895 | Ebert |
| 1,470,235 | A | 10/1923 | House, Jr. |
| 1,561,200 | A | 10/1925 | Wiseman |
| 1,731,585 | A | 10/1929 | McGhee et al. |
| 1,736,598 | A | 11/1929 | Hyatt |

(Continued)

OTHER PUBLICATIONS

*"Portable Fuel Container Spillage Control Regulations—Final Statement of Reasons ," State of California Environmental Protection Agency Air Resources Board, Jun. 2000, 47 pages.

*"Regulations—Portable Fuel Containers and Spouts ," State of California Environmental Protection Agency Air Resources Board, Adopted: Jul. 6, 2000, 15 pages.

*"Spill–Proof System and Spill–Proof Spout Test Procedure—Test Method 510—Automatic Shut–Off Test Procedure For Spill–Proof Systems and Spill–Proof Spouts," State of California Environmental Protection Agency Air Resources Board, Adopted: Jul. 6, 2000 (section numbers corrected Sep. 13, 2000), 6 pages.

(Continued)

*Primary Examiner*—Steven O. Douglas
(74) *Attorney, Agent, or Firm*—Wallenstein Wagner & Rockey, Ltd.

(57) ABSTRACT

A spill-proof pour spout for transferring fluid from a container to a vessel comprising a base having an inner sleeve extending outwardly therefrom, a conduit member located in the inner sleeve, and an outer sleeve slidingly engaging the inner sleeve. The conduit member has a fluid tube, and air tube and an end cap. The outer sleeve is in a first closed position wherein the outer sleeve contacts the end cap preventing fluid flow from the pour spout. The pour spout can only be opened by rotating the outer sleeve to a first or second indexing position. By rotating the outer sleeve either clockwise or counterclockwise relative to the inner sleeve, the outer sleeve is adapted to be slid to a first open position permitting fluid to flow at a first flow rate through the fluid tube and out of the pour spout. By further rotating the outer sleeve either clockwise or counterclockwise, the outer sleeve is adapted to be slid to a second open position permitting fluid to flow at a second flow rate through the fluid tube at a second flow rate and out of the pour spout.

37 Claims, 8 Drawing Sheets

U.S. PATENT DOCUMENTS

| | | | |
|---|---|---|---|
| 1,745,011 | A | 1/1930 | Fréjacques |
| 2,197,368 | A | 4/1940 | Minard |
| 2,325,419 | A | 7/1943 | Minard |
| 2,326,251 | A | 8/1943 | Piquerez |
| 2,620,110 | A | 12/1952 | Spencer |
| 2,723,793 | A | 11/1955 | Hubbell |
| 3,207,190 | A | 9/1965 | Silibereis |
| 3,540,402 | A | 11/1970 | Kocher |
| 3,845,791 | A | 11/1974 | Friendship |
| 4,232,715 | A | 11/1980 | Pyle |
| 4,513,797 | A | 4/1985 | Tompkins, Jr. |
| 4,556,093 | A | 12/1985 | Jones |
| 4,598,743 | A | 7/1986 | Milling |
| 4,651,889 | A | 3/1987 | Uranishi et al. |
| 4,667,710 | A | 5/1987 | Wu |
| 4,667,711 | A | 5/1987 | Draft |
| 4,834,151 | A | 5/1989 | Law |
| 4,984,612 | A | 1/1991 | de la Haye |
| 5,069,260 | A | 12/1991 | Shea |
| 5,076,333 | A | 12/1991 | Law |
| 5,095,937 | A | 3/1992 | LeBlanc et al. |
| 5,228,487 | A | 7/1993 | Thiermann et al. |
| 5,234,038 | A | 8/1993 | Mitchell et al. |
| 5,241,983 | A | 9/1993 | Lagache |
| 5,249,611 | A | 10/1993 | Law |
| 5,406,994 | A | 4/1995 | Mitchell et al. |
| 5,419,378 | A | 5/1995 | Law |
| 5,628,352 | A | 5/1997 | Gracyalny et al. |
| 5,704,408 | A | 1/1998 | Law |
| 5,762,117 | A | 6/1998 | Law |
| 6,227,419 | B1 | 5/2001 | Raboin |
| 6,397,902 | B1 | 6/2002 | Murphy |
| 6,478,058 | B1 | 11/2002 | Pears |

OTHER PUBLICATIONS

*"Spill–Proof System and Spill–Proof Spout Test Procedure—Test Method 511—Automatic Closure Test Procedure For Spill–Proof Systems and Spill–Proof Spouts," State of California Environmental Protection Agency Air Resources Board, Adopted: Jul. 6, 2000 (section numbers corrected Sep. 13, 2000), 8 pages.

*"Spill–Proof System and Spill–Proof Spout Test Procedure—Test Method 512—Determination of Fuel Flow Rate For Spill–Proof Systems and Spill–Proof Spouts," State of California Environmental Protection Agency Air Resources Board, Adopted: Jul. 6, 2000 (section numbers corrected Sep. 13, 2000), 5 pages.

*"Spill–Proof System and Spill–Proof Spout Test Procedure—Test Method 513—Determination of Permeation Rate For Spill–Proof Systems," State of California Environmental Protection Agency Air Resources Board, Adopted: Jul. 6, 2000 (section numbers corrected Sep. 13, 2000), 8 pages.

HIGH FLOW POSITION

LOW FLOW POSITION

CLOSED POSITION

MULTI-FLOW POUR SPOUT AND ADAPTER

CROSS-REFERENCE TO RELATED APPLICATIONS

This is a continuation-in-part of U.S. patent application Ser. No. 10/075,781, filed Feb. 14, 2002, now U.S. Pat. No. 6,598,630 upon which a claim of priority is based.

BACKGROUND OF THE INVENTION

This invention relates to pour spouts for containers of fluid, and more particularly to pour spouts which permit transfers of fluid (liquid) based on the influence of gravity at multiple flow rates, and without the risk of spills or overflow, and also to adapters that can be affixed to pour spouts for desirous results.

It is desirable to avoid overfilling of fuel to internal combustion engines in lawnmowers, tractors, personal water craft, chain saws and power tools, outboard motors, ATV recreational vehicles and even automobiles. Spilled fuel presents health and safety risks to people and the environment in general. As a result, many states have now passed environmental legislation which regulates pour spouts which can be used in conjunction with volatile fuels and other liquids.

The opportunity for spills have various causes. First, often times the gas tanks in the aforementioned internal combustion engines have very narrow openings which requires precise pouring and/or a facilitating pour spout or funnel to prevent spills.

Many times spills occur because the operator of the pour spout does not know when the receiving vessel is full. In these cases, overflows occur before pouring can be terminated.

Yet another cause of spills is the ineffective venting of the container from which the fluid is being transferred. The result of ineffective venting is an uneven fluid flow, and even in some cases surging of the fluid. Surges can cause splashing and an uneven flow makes it extremely difficult to predict fluid levels in the receiving vessel.

Another problem encountered by gravity influenced pour spouts is airlock caused by improper venting. Airlock occurs as a result of improper venting in combination with specific volume and viscosity parameters of the fluid being transferred. Such a condition can result in fluid which will not pour even when the container is inverted. This problem, while annoying, can normally be resolved by turning the container right side up again. However, this only increases the opportunity for spills.

Examples of prior spill-proof pour spouts include U.S. Pat. Nos. 4,598,743, 4,834,151, 5,076,333, 5,249,611, 5,419,378, 5,704,408, and 5,762,117. These pour spouts all have at least the following drawbacks: they do not provide multiple flow rate options and they do not provide child-proof locks.

Additionally, known pour spouts are limited in their compatibility with multiple vessel types, especially in light of certain state regulations requiring specific spout diameters for certain applications. One example is the State of California, which requires a spout diameter of 1 inch. This poses a problem if one desires to use the same spout for filling a fuel tank of an automobile, the fuel tank receptacle of which has a standard size opening of ¾ inch.

The present invention addresses these problems, as well as many other problems.

SUMMARY OF THE INVENTION

Pour Spout

In a first embodiment, a pour spout for transferring fluid from a container to a vessel is provided. The pour spout comprises a base having an inner sleeve extending outwardly therefrom, a conduit member located in the inner sleeve, and an outer sleeve slidingly engaging the inner sleeve. The conduit member has a fluid tube, an air tube and an end cap. The outer sleeve is in a first closed position wherein the outer sleeve contacts the end cap preventing fluid flow from the pour spout. The pour spout can only be opened by rotating the outer sleeve to a first or second indexed position. By rotating the outer sleeve relative to the inner sleeve, the outer sleeve is adapted to be slid to a first open position permitting fluid to flow at a first flow rate through the fluid tube and out of the pour spout. By further rotating the outer sleeve, the outer sleeve is adapted to be slid to a second open position permitting fluid to flow at a second flow rate through the fluid tube at a second flow rate and out of the pour spout.

In a second embodiment, a pour spout for transferring fluid from a container to a vessel is provided wherein the pour spout comprises a base having an inner sleeve extending outwardly therefrom, a conduit member located in the inner sleeve and an outer sleeve slidingly engaging the inner sleeve. The conduit member has a fluid tube, a first air tube, a second air tube and an end cap. A biasing member urges the outer sleeve into an initial closed position that precludes the transfer of fluid through the pour spout. The base has a protrusion which coacts with the outer sleeve and a plurality of slots in the outer sleeve to facilitate an initial closed position, a first open position and a second open position. The outer sleeve also has a shoulder for coacting with the vessel to slide the outer sleeve relative to the inner sleeve from the closed position to either a first or a second open position.

Adapter An adapter for a pour spout for transferring fluid from a container to a vessel is also provided. The pour spout is removably connectable to the container and includes an inner sleeve, a conduit member disposed within the inner sleeve and forming a fluid tube and an air tube therein, and an outer sleeve disposed around the inner sleeve and moveable with respect thereto. The outer sleeve is moveable to a closed position wherein the outer sleeve cooperates with the conduit member to prevent fluid flow from the pour spout. The outer sleeve is also moveable to a flow position wherein the air tube is in communication with ambient air to allow air to flow therethrough to facilitate flow of the fluid through the fluid tube.

The adapter comprises a cylindrically-shaped shroud portion having a distal end and defining an interior space. The shroud portion is adapted to removably attach to the outer sleeve of the pour spout such that the outer sleeve is disposed within the interior space of the shroud portion and the adapter is moveable therewith. A tip portion is disposed at the distal end of the shroud portion, the tip portion including a shoulder surface and a fluid opening. The tip portion has a tip diameter dimension less than a diameter dimension defined by the cylindrically-shaped shroud portion. The tip portion is adapted to be insertable into a vessel receptacle such that when the shoulder surface is urged against a surface of the vessel, the outer sleeve moves to the flow position to allow fluid to flow through the fluid opening of the tip portion of the adapter and into the vessel.

These and other aspects of the present invention will be discussed with reference to the drawings and detailed description.

DETAILED DESCRIPTION OF THE INVENTION

Figure 1:
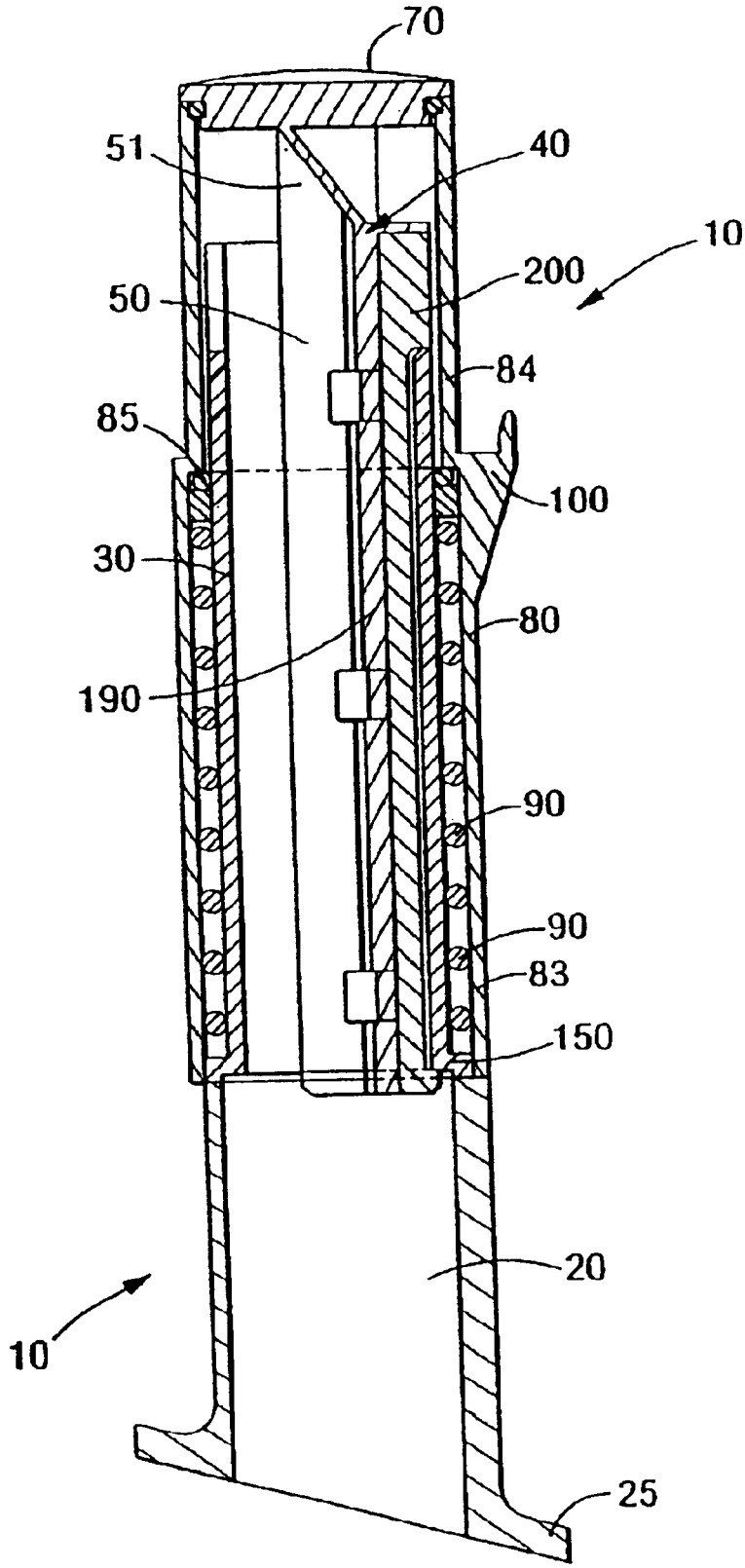
FIG. 1 is a cross-sectional view of a pour spout according to one embodiment of the present invention.

While this invention is susceptible of embodiment in many different forms, there is shown in the drawings, and will be described herein in detail, specific embodiments thereof with the understanding that the present disclosure is to be considered as an exemplification of the principles of the invention and is not intended to limit the invention to the specific embodiments illustrated.

Pour Spout

Figure 2C:
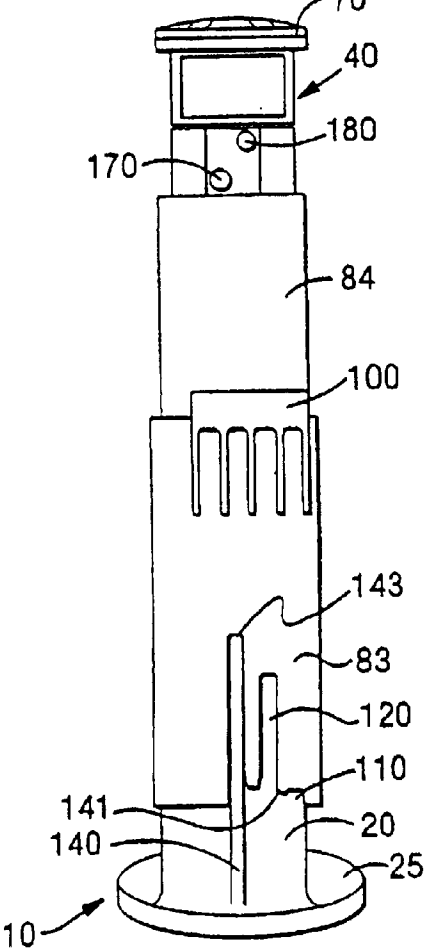
FIG. 2C is a first elevational view of the pour spout shown in FIGS. 2A and 2B in a second open position.
Figure 2B:
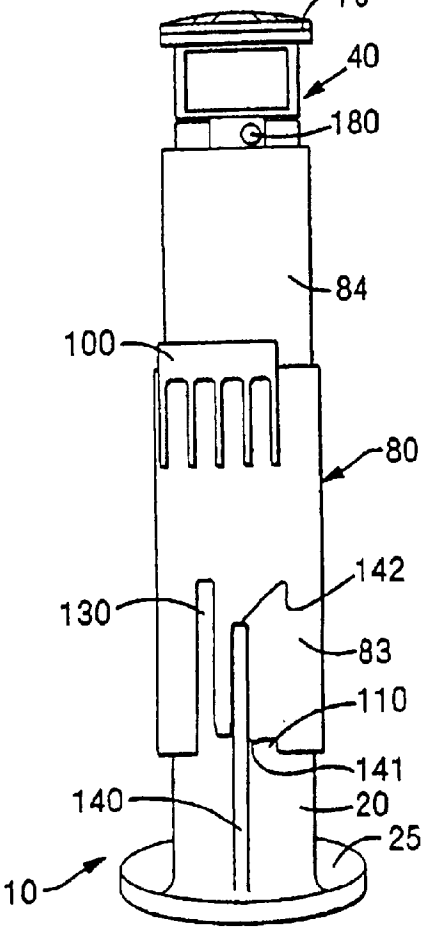
FIG. 2B is a first elevational view of the pour spout shown in FIG. 2A in a first open position.
Figure 2A:
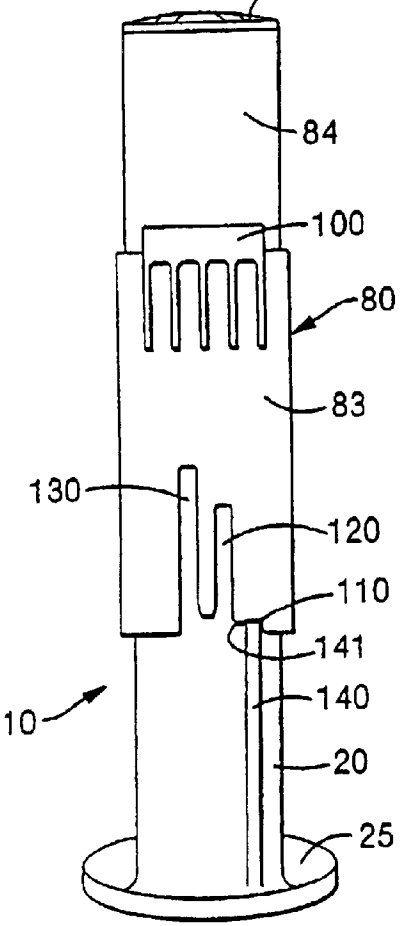
FIG. 2A is a first elevational view of a pour spout according to one embodiment of the present invention in a closed position.

Referring to FIGS. 1–13 there is shown a spill-proof pour spout 10 according to a preferred embodiment of the present invention. As shown in FIG. 1, the spill-proof pour spout 10 includes a base 20 having an inner sleeve 30 extending outwardly therefrom. A conduit member 40 is located in the inner sleeve 30 and includes a fluid tube 50, a first and a second air tube 60, 61 (see FIG. 9) and an end cap 70. An outer sleeve 80 engages the inner sleeve 30 and is held in a normally closed position by a biasing member 90, such as a spring or elastomeric member. In the normally closed position, the outer sleeve 80 is biased against the end cap 70 by the biasing member 90, thereby preventing flow through the fluid tube 50. The outer sleeve 80 is rotatably and slidably moveable with respect to the inner sleeve 30 to facilitate multiple positions of the pour spout 10. In a preferred embodiment, the pour spout 10 is positionable in three indexed positions, a locked position as shown in FIG. 2A, a low flow position as shown in FIG. 2B, and a high flow position as shown in FIG. 2C. It is to be understood, however, that the pour spout 10 can be provided with numerous other positions, including additional positions for additional flow rates.

When describing the functionality of the spill-proof pour spout 10 of the present invention, it will be presumed that the pour spout 10 is attached to a fluid-filled container, such as, for example, a gasoline container, and a user of the pour spout is attempting to transfer fluid from the container to a receiving vessel having a receptacle into which the spout can be inserted.

Figure 3B:
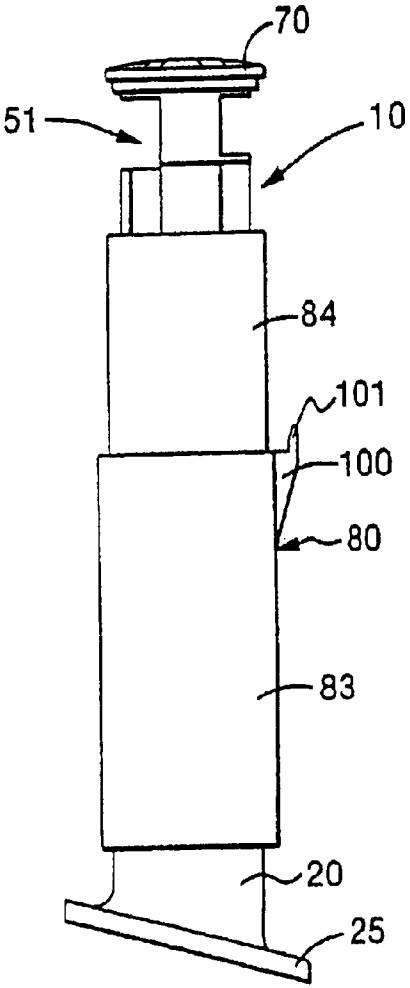
FIG. 3B is a second elevational view of the pour spout shown in the second open position of FIG. 2C.
Figure 3A:
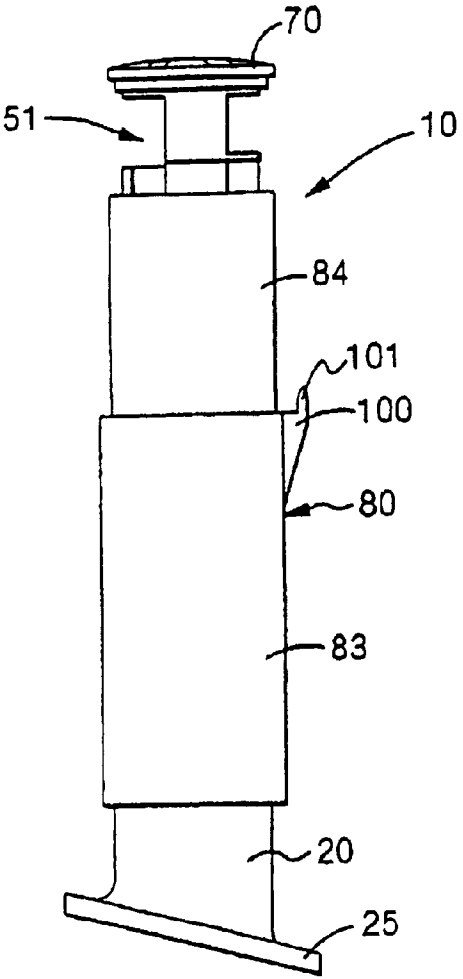
FIG. 3A is a second elevational view of the pour spout shown in the first open position of FIG. 2B.

As shown in FIGS. 2A–2C, the outer sleeve 80 also includes a first slot 110, a second slot 120 and a third slot 130. The base 20 includes a protrusion 140 that cooperates with the slots 110,120,130 in the outer sleeve 80 to facilitate indexable positioning of the pour spout 10. The outer sleeve 80 is rotatable with respect to the inner sleeve 30 so that the protrusion 140 can be aligned with one of the slots 110,120, 130. The first slot 110 facilitates a locked position. The outer sleeve 80 includes a detent 141 that maintains the protrusion 140 within the slot 110 in a locked position. The pour spout 10 can be unlocked when a sufficient force is applied to the outer sleeve 80 with respect to the inner sleeve 30 to allow the protrusion 140 to slide past the detent 141. Once unlocked, the outer sleeve 80 can be rotated with respect to the inner sleeve 30 to allow alignment of the protrusion 140 with one of the slots 120,130, which, in turn, allows the inner sleeve to be slid into an open position. As shown in FIGS. 3A and 3B, the outer sleeve 80 of the pour spout 10 includes a shoulder 100 having a lip 101. The shoulder 100 of the outer sleeve 80 coacts with the receptacle of the receiving vessel to permit the outer sleeve 80 to slide relative to the inner sleeve 30 into an open position when pressure is applied to the spout 10 by the user. As shown in FIGS. 2B and 3A, a low flow open position is achieved when the outer sleeve 80 is slid such that the protrusion 140 is held against an end surface 142 of the slot 120. In similar fashion, as shown in FIGS. 2C and 3B, a high flow position is achieved when the outer sleeve 80 is slid such that the protrusion 140 is held against an end surface 143 of the slot 130.

It should be noted that in the locked position, the outer sleeve 80 is maintained in the normally biased closed position against the end cap 70. In order to allow the protrusion 140 to rotate past the detent 141, a plastic material may be utilized that allows some flexion of the detent and/or protrusion. Additionally, an elastomeric compression-type seal may be utilized below the end cap 70 that will allow the outer sleeve 80 to be slidably pushed against the end cap just enough to further compress the seal and allow the protrusion to rotate past the detent 141.

Figure 4:
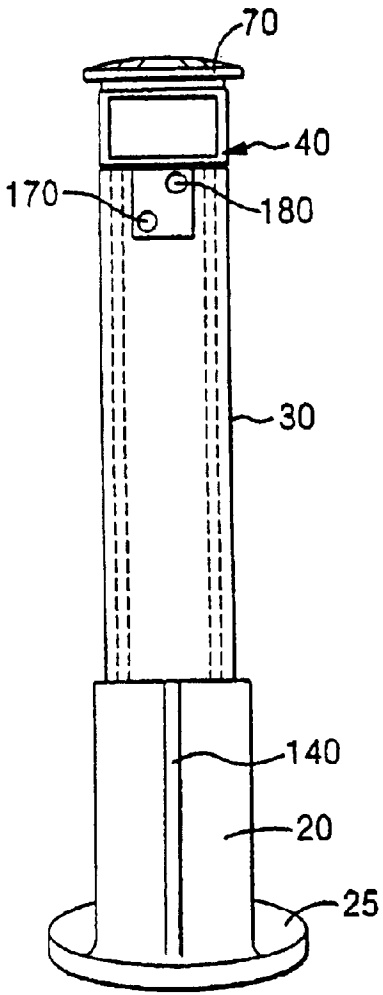
FIG. 4 is an elevational view of the pour spout shown in FIGS. 2A–2C without the outer sleeve and bias member.
Figure 5:
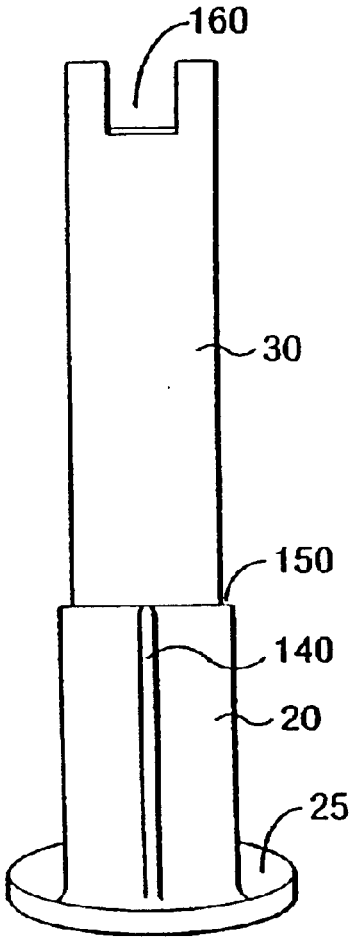
FIG. 5 is an elevational view of the base of the pour spout shown in FIGS. 1–4.

Referring now to FIGS. 4 and 5, in the preferred embodiment illustrated, the base 20 has a larger diameter than the inner sleeve 30 which extends outwardly from one end of the base 20. This creates a step 150 that extends radially around one end of the base 20. As shown in FIG. 1, the biasing member 90 in the preferred embodiment is a spring that is disposed around the inner sleeve 30, with one end of the spring 90 resting on the step 150. Referring once again to FIG. 5, at the end of the inner sleeve 30 opposite the base 20, there is a notched portion 160 which receives the conduit member 40 as will be explained further below. The other end of the base 20 has a connector flange 25 that cooperates with a threaded collar of a container (not shown) to facilitate connection of the pour spout 10 to the container.

Figure 6:
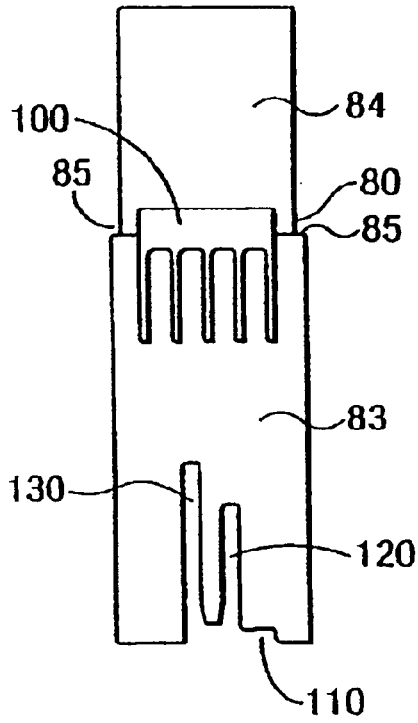
FIG. 6 is an elevational view of the outer sleeve of the pour spout shown in FIGS. 1–3.
Figure 7:
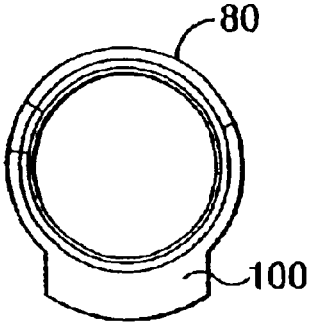
FIG. 7 is a top plan view of the outer sleeve shown in FIG. 6.

As shown in FIG. 6, the outer sleeve 80 is comprised of a first hollow tube portion 83 and a second hollow tube portion 84. The first hollow tube portion 83 has a larger diameter than the second hollow tube portion 84, thereby creating an inner annular step 85 around the outer sleeve 80. The shoulder 100 extends from one end of the first hollow tube portion 83 of the outer sleeve 80. The opposite end of the first hollow tube portion 83 of the outer sleeve 80 includes the slots 110,120,130. As shown in FIG. 1, when the outer sleeve 80 is placed over the inner sleeve 30 and biasing member 90, the biasing member 90 is confined between, and bears against, the step 150 in the base 20 and the inner annular step 85 of the outer sleeve 80. As mentioned above, the biasing member 90 keeps the pour spout 10 in a normally closed position with the second hollow tube portion 84 of the outer sleeve 80 forming a seal with the end cap 70 of the conduit member 40. A top plan view of the outer sleeve 80 is shown in FIG. 7.

Figure 8:
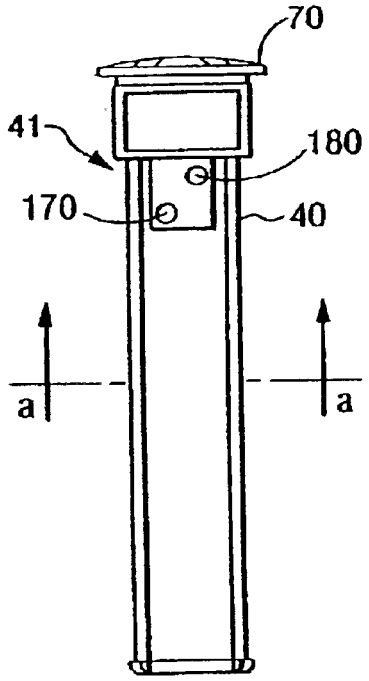
FIG. 8 is an elevational view of the conduit member shown in FIGS. 1–4.
Figure 9:
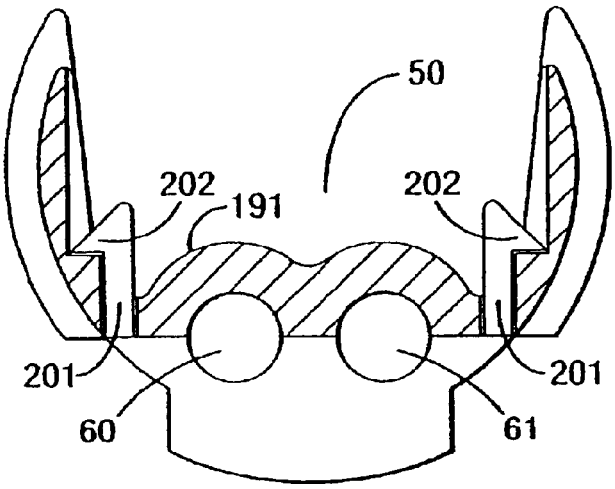
FIG. 9 is a cross-sectional view of the two-piece fluid and air tube taken along line a—a in FIG. 8.
Figure 10:
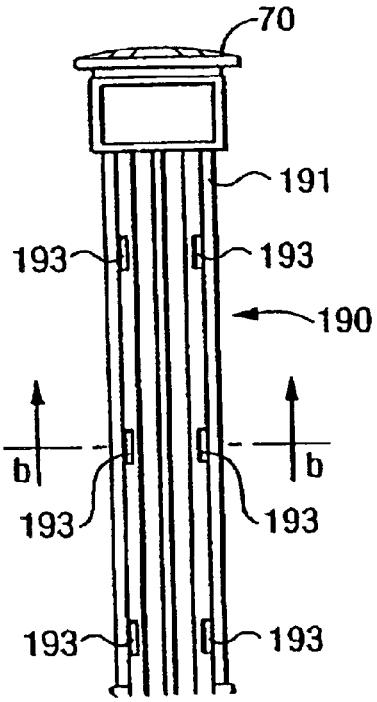
FIG. 10 is an elevational view of the back channel of the two-piece fluid and air tube shown in FIG. 9.
Figure 11:
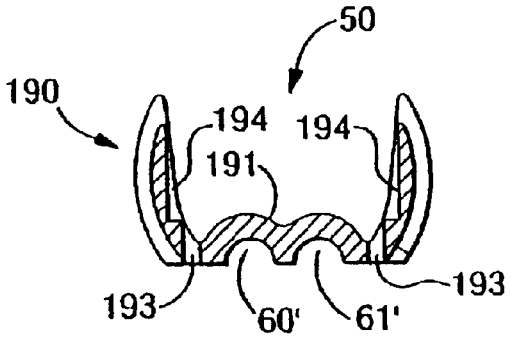
FIG. 11 is an enlarged cross-sectional view of the back channel of the two-piece fluid and air tube taken along section line b—b in FIG. 10.
Figure 12:
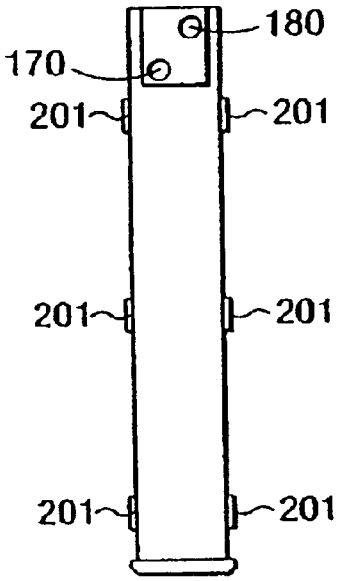
FIG. 12 is an elevational view of the air tube cover of the two-piece fluid and air tube shown in shown in FIGS. 8 and 9.
Figure 13:
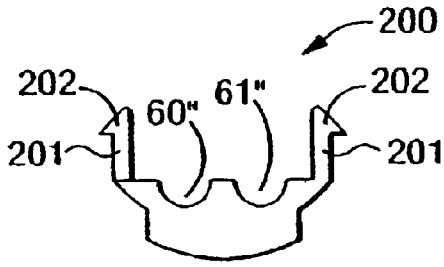
FIG. 13 is an enlarged top plan view of the air tube cover shown in FIG. 12.

In the preferred embodiment shown in FIGS. 8 and 9, the conduit member 40 includes the first and the second air tubes 60, 61, the fluid tube 50 and the end cap 70. In this particular embodiment, the air tubes 60,61 form discrete channels that are separate from the fluid tube 50. Alternatively, a single air tube can be utilized. A tip portion 41 of the conduit member 40 is exposed when the outer sleeve 80 is slid to either the first (See FIG. 2B) or the second (See FIG. 2C) open position. Referring to FIG. 1, in the tip portion 41 of the conduit member 40, the fluid tube 50 diffuses to form a fluid discharge opening 51 adjacent the end cap 70. As shown in FIGS. 8 and 9, a first air vent aperture 170 is in the tip portion 41 of the conduit member 40 and communicates with the first air tube 60. The first air vent aperture 170 is transverse to the first air tube 60 and has the same diameter as the first air tube 60. A second air vent aperture 180 is also located in the tip portion 41 of the conduit member 40 and communicates with the second air tube 61. The second air vent aperture 180 is transverse to the second air tube 61 and has the same diameter as the second air tube 61.

When the outer sleeve 80 is slid to the first open position (See FIGS. 2B and 3A), the end cap 70 and the second hollow tube portion 84 of the outer sleeve 80 no longer form a seal preventing fluid from flowing through the pour spout 10. Instead, the second air vent aperture 180 and the fluid discharge opening 51 of the conduit member 40 are exposed to the ambient atmosphere (i.e., within the vessel). Air flows from the air vent aperture 180 through the second air tube 61 allowing fluid to flow from the container through the fluid tube 50 and out the fluid discharge opening 51 as a result of a pressure differential between the atmosphere and the pressure developed in the container. This venting means also allows for an even air to fluid volume displacement resulting in an even rate of fluid flow.

When the outer sleeve 80 is slid to the second open position (See FIGS. 2C and 3B), the first and second air vent apertures 170, 180 and the fluid discharge opening 51 are exposed to the ambient atmosphere. Air flows from air vent apertures 170, 180 through air tubes 60, 61 allowing fluid to flow from the container through the fluid tube 50 and out the fluid discharge opening 51. Because the pressure differential is greater when both air vent apertures are exposed, the fluid flow rate in the second open position of the pour spout 10 is greater than the fluid flow rate in the first open position of the pour spout 10.

In a preferred embodiment illustrated in FIGS. 10–13, the conduit member 40 is constructed of two separate pieces for ease of manufacture: a fluid and air tube back channel 190 and an air tube cover 200. Back channel 190 includes the fluid tube 50, fluid discharge opening 51, end cap 70. A divider wall 191 runs from the end cap 70 to the opposite end of the back channel 190. The divider wall 191 separates the fluid tube 50 from the air tubes 60, 61. However, in the preferred embodiment, a portion of the diameter of air tubes 60, 61 are formed in the divider wall 191. The portions of the air tubes 60, 61 formed in the divider wall 191 are designated 60', 61' in FIGS. 10–11. In addition, the back channel 191 has a plurality of slots 193 and recessed grooves 194 for receiving tabs 201 and catches 202 from the air tube cover 200. The remaining portions of the air tubes 60, 61 are formed in the air tube cover 200 and are designated 60", 61" in FIG. 13. The air tube cover 200 includes the air vent apertures 170, 180. The air vent apertures 170, 180 are transverse to and intersect the semi-formed air tubes 60", 61". When assembled, the tabs 201 and catches 201 are inserted in the slots and snap fitted into the recessed grooves 194. FIG. 9 illustrates the assembled two-piece conduit member 40.

Figure 14:
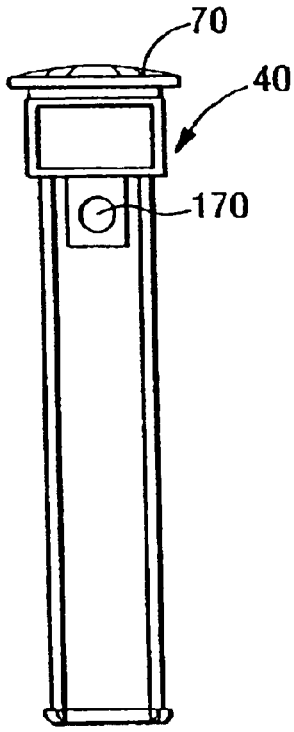
FIG. 14 is an elevational view of a second embodiment of the conduit member.
Figure 16:
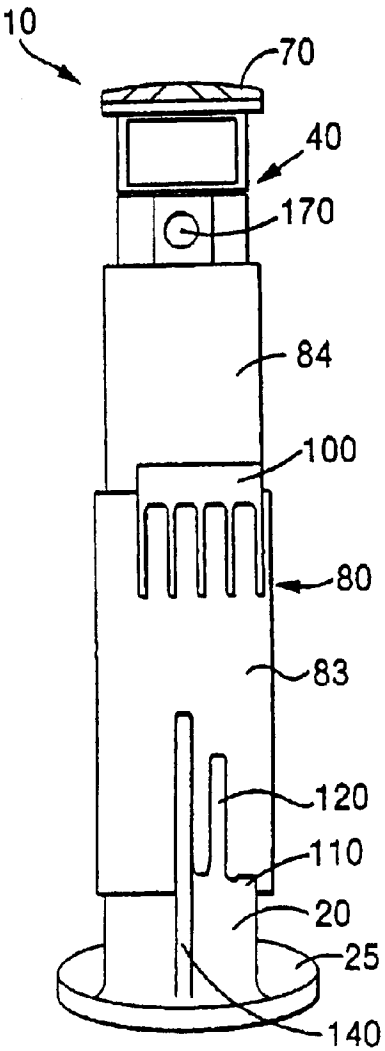
FIG. 16 is an elevational view of a pour spout having the conduit member shown in FIG. 14 in a second open position.
Figure 15:
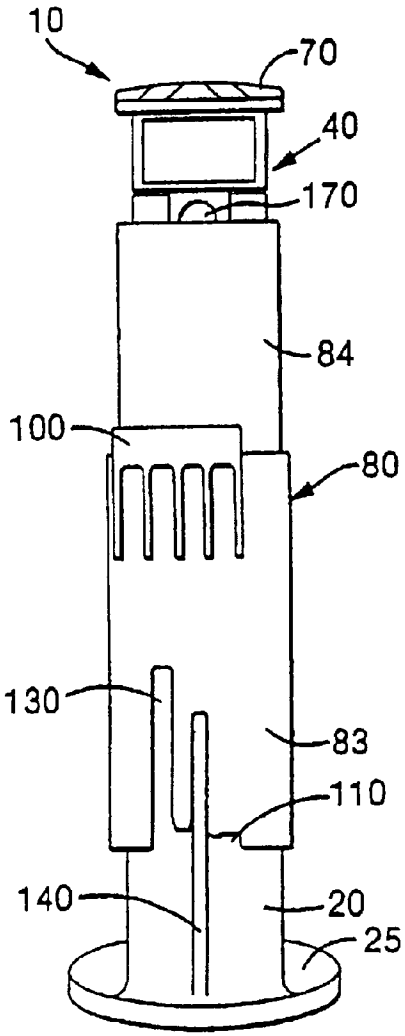
FIG. 15 is an elevational view of a pour spout having the conduit member shown in FIG. 14 in a first open position.
Figure 21:
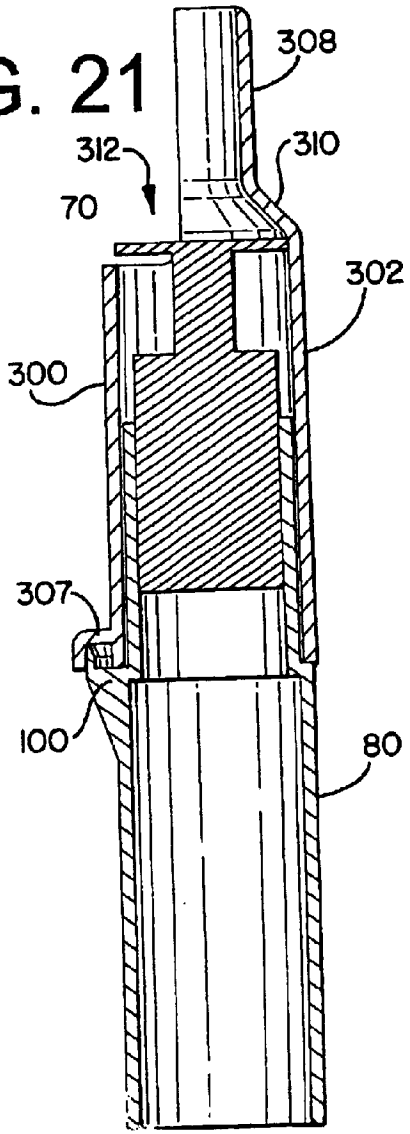
FIG. 21 is a cross-sectional view taken along section line 21—21 in FIG. 20.
Figure 20:
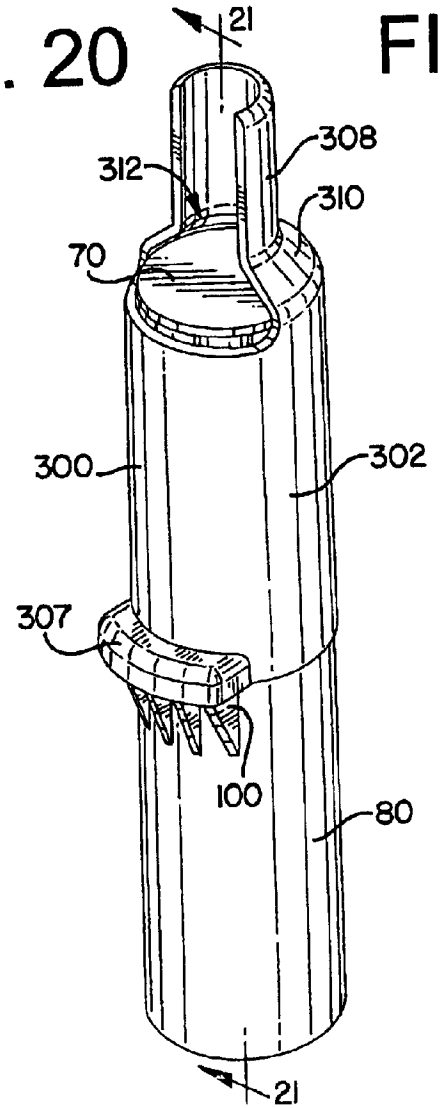
FIG. 20 is a perspective view of the adapter of FIG. 18 removably attached to a pour spout in accordance with the principles of the present invention.
Figure 19:
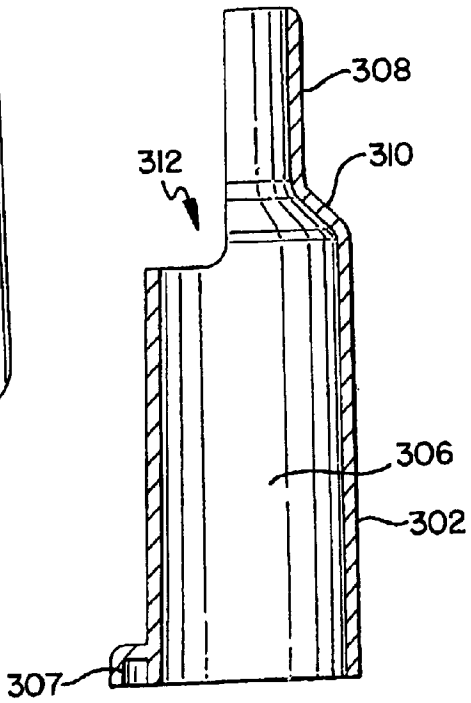
FIG. 19 is a cross-sectional view taken along section line 19—19 in FIG. 18.
Figure 18:
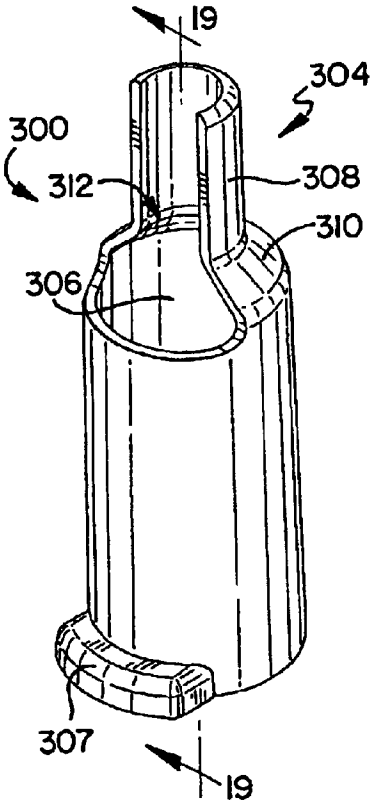
FIG. 18 is a perspective view of an adapter for a pour spout in accordance with the principles of the present invention.

Another embodiment of the present invention is shown in FIGS. 14–16. In this embodiment, there is only a single air tube 60 in the conduit member 40. As a result there is also only a single air vent aperture 170. The diameter of the air vent aperture 170 is the same as the air tube 60. With reference specifically to FIG. 15, when the outer sleeve 80 is slid into the first open position, a first portion of the air vent aperture 170 is exposed. As shown in FIG. 16, the entire air vent aperture 170 is exposed in the second open position. Alternatively, a greater portion of the air vent aperture 170 may be exposed in the second position compared to that of the first position. In all other respects, the embodiment illustrated in FIGS. 14–16 is the same as the embodiment illustrated in FIGS. 1–13 and discussed above.

Figure 17:
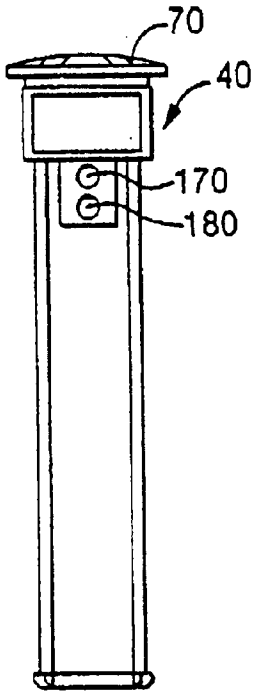
FIG. 17 is an elevational view of a third embodiment of the conduit member.

In yet another embodiment illustrated in FIG. 17, there is a single air tube 60 in the conduit member 40. However, rather than having a single air vent aperture 170, there are first and second air vent apertures 170, 180 which communicate with the single air tube 60. The first and second air vent apertures 170, 180 are transverse to, and have the same diameter as, the air tube 60. In the first open position, only the first air vent aperture 170 is exposed. In the second open position, the first and second air vent apertures 170,180 are exposed. Alternatively, in each of the positions, only a portion of the air vent apertures 170, 180 are exposed. In all other respects, the embodiment illustrated in FIGS. 14–16 is the same as the embodiment illustrated in FIGS. 1–13 and discussed above.

It should be noted that for all of the embodiments described, when an air vent aperture is exposed in a particular indexed position of the outer sleeve 80, it may be partially covered by the outer sleeve 80. The resulting partial exposure of an air vent aperture regulates the intake of air through the associated air tube(s), thereby governing the flow rate. By changing the amount in which the air vent aperture is exposed, pour spout designs having various multiple flow rate positions can be achieved. Thus, for certain flow rates, a given air vent aperture may not be fully exposed to the ambient atmosphere.

It should also be noted that the indexed positioning of the outer sleeve can be achieved through means other than a slot and protrusion combination. For example, a series of detents can be provided on either the outer surface of the inner sleeve or the inner surface of the outer sleeve that coact with a corresponding protrusion on an opposing surface. Such an arrangement would be within the skill of one of ordinary skill in the mechanical arts.

Adapter

Referring to FIGS. 18–21, an adapter 300 for the pour spout 10 is provided. The adapter 300 comprises a cylindrically-shaped shroud portion 302 having a distal end 304 and defining an interior space 306. The shroud portion 302 is adapted to removably attach to the outer sleeve 80 of the pour spout 10 such that the outer sleeve 80 is disposed within the interior space 306 of the shroud portion 302 and the adapter 300 is moveable therewith. The adapter 300 includes a pocket 307 that removably engages the shoulder 100 of the outer sleeve 80.

A tip portion 308 is disposed at the distal end 304 of the shroud portion 302. The tip portion 308 includes a shoulder surface 310 and a fluid opening 312. The tip portion 308 has a tip diameter dimension less than a diameter dimension defined by the cylindrically-shaped shroud portion 302. The tip portion 308 is adapted to be insertable into a vessel receptacle (not shown) such that when the shoulder surface 310 is urged against a surface of the vessel, the outer sleeve 80 moves to the flow position to allow fluid to flow through the fluid opening 312 of the tip portion 308 of the adapter 300 and into the vessel.

The adapter 300 allows the pour spout 10 to cooperate with different vessels having various sizes and shapes of openings without requiring an additional pour spout. Merely by way of example, the State of California Air Resources Board requires a pour spout diameter of 1 inch. A standard fuel tank receptacle of an automobile, however, has an opening diameter of ¾ inch. The adapter 300 would allow the pour spout 10 to be utilized in connection with a fuel tank receptacle of an automobile.

It is contemplated that several adapters can also be provided, each having a corresponding flow rate defined by the tip portion 308 and fluid opening 312, which would allow for changing the pour spout flow rate by changing the adapter affixed thereto. This is accomplished by varying the dimensions between the pour spout 10 and the adapter 300, such as varying the clearance between the tip 70 and the tip portion 308, the shoulder surface 310, and/or fluid opening 312.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed is:

1. A pour spout for transferring fluid from a container to a vessel, the pour spout comprising:

a base having an inner sleeve extending outwardly therefrom;

a fluid passage and an air passage disposed within the inner sleeve; and an outer sleeve moveably engaging the inner sleeve, wherein the outer sleeve is capable of being moved to:

a closed position that prevents fluid from flowing through the fluid passage;

a first open position that permits fluid to flow at a first flow rate through the fluid passage; and a second open position that permits fluid to flow at a second flow rate through the fluid passage;

the pour spout configured to prevent the outer sleeve from moving beyond its respective open position when it is in either open position.

2. The pour spout of claim 1, wherein the pour spout includes a slot and protrusion arrangement that is configured to prevent the outer sleeve from moving beyond its respective position when it is in either open position.

3. The pour spout of claim 2, wherein the slot and protrusion arrangement includes a first and a second slot in the outer sleeve and a first and a second protrusion disposed on the inner sleeve, the first slot and protrusion cooperating to prevent the outer sleeve from moving beyond the first open position, and the second slot and protrusion cooperating to prevent the outer sleeve from moving beyond the second open position.

4. The pour spout of claim 1, wherein the pour spout further comprises a conduit member disposed within the inner sleeve and forming the fluid passage and air passage.

5. The pour spout of claim 1, the outer sleeve capable of being moved to a locked position that prevents the outer sleeve from being moved from the closed position.

6. A pour spout for transferring fluid from a container to a vessel, the pour spout removably connectable to the container and comprising an inner sleeve having a fluid passage and an air passage therein, and an outer sleeve disposed around the inner sleeve and moveable with respect to the inner sleeve, the outer sleeve being moveable to:

a closed position that prevents fluid from flowing through the fluid passage;

a first flow rate position wherein the air passage is in communication with ambient air to allow air to flow therethrough at a first air flow rate to facilitate flow of the fluid through the fluid passage at a first fluid flow rate; and a second flow rate position wherein the air passage is in communication with ambient air to allow air to flow therethrough at a second air flow rate to facilitate flow of the fluid through the fluid passage at a second flow rate;

the outer sleeve configured to be maintained in its respective flow rate position when a force is continuously applied to the outer sleeve sufficient to move the outer sleeve with respect to the inner sleeve.

7. The pour spout of claim 6, wherein the outer sleeve includes a slot that is configured to engage a protrusion disposed on the inner sleeve to prevent the outer sleeve from moving beyond its respective flow rate position.

8. The pour spout of claim 6, wherein the outer sleeve includes a first and a second slot and the inner sleeve includes a first and a second protrusion, the first slot and protrusion cooperating to prevent the outer sleeve from moving beyond the first flow rate position, and the second slot and protrusion cooperating to prevent the outer sleeve from moving beyond the second flow rate position.

9. The pour spout of claim 8, wherein the outer sleeve is rotatably moveable with respect to the inner sleeve to allow alignment of the respective slots and protrusions and permit the outer sleeve to be slid with respect to the inner sleeve to one of the first and second flow rate positions.

10. The pour spout of claim 6, the outer sleeve further being movable to a locked position that prevents the outer sleeve from being moved from the closed position.

11. A pour spout for transferring fluid from a container to a vessel, the pour spout removably connectable to the container and including an inner sleeve having an air passage and a fluid passage formed therein, and an outer sleeve disposed around the inner sleeve and moveable with respect to the inner sleeve, the outer sleeve capable of being placed in a closed position wherein the outer sleeve prevents fluid flow from the pour spout, a first open position wherein the air passage is in communication with ambient air to allow air to flow through the air passage to facilitate flow of the fluid through the fluid passage at a first fluid flow rate, and a second open position wherein the air passage is in communication with ambient air to allow air to flow through the air passage to facilitate flow of the fluid through the fluid passage at a second flow rate, the inner sleeve and the outer sleeve cooperatively configured such that the outer sleeve is maintained in its respective flow rate position when it is placed in its respective flow rate position and a force is continuously applied to the outer sleeve sufficient to move the outer sleeve with respect to the inner sleeve.

12. The pour spout of claim 11, wherein the inner sleeve and the outer sleeve are configured with a slot and protrusion arrangement that cooperate to maintain the outer sleeve in its respective flow rate position when the force is continuously applied to the outer sleeve sufficient to move the outer sleeve with respect to the inner sleeve.

13. The pour spout of claim 11, wherein the outer sleeve includes a slot and the inner sleeve includes a protrusion configured to cooperate with the slot to maintain the outer sleeve in its respective open position when the force is continuously applied to the outer sleeve sufficient to move the outer sleeve with respect to the inner sleeve.

14. The pour spout of claim 11, the outer sleeve capable of being placed in a locked position that prevents the outer sleeve from being moved from the closed position.

15. A pour spout for transferring fluid from a container to a vessel, the pour spout removably connectable to the container and comprising an inner sleeve having an air passage and a fluid passage disposed therein, and an outer sleeve disposed around the inner sleeve and capable of sliding and rotating movement with respect to the inner sleeve, the inner and outer sleeves configured with a slot and protrusion arrangement, the outer sleeve capable of being rotated with respect to the inner sleeve to:

a locked position wherein the protrusion prevents the outer sleeve from being slid from a closed position, the closed position preventing fluid from flowing through the fluid passage; and an unlocked position wherein the slot and protrusion arrangement cooperate to allow the outer sleeve to be slid from the closed position to an open position defined by the slot and protrusion arrangement.

16. The pour spout of claim 15, wherein the slot and protrusion arrangement define the open position by preventing the outer sleeve from sliding beyond the open position when a force is continuously applied to the outer sleeve sufficient to move the outer sleeve with respect to the inner sleeve.

17. The pour spout of claim 15, wherein the slot and protrusion arrangement further defines a second open position.

18. The pour spout of claim 17, wherein the slot and protrusion arrangement comprises a first and a second slot in the outer sleeve and a first and a second protrusion disposed on the inner sleeve, the first slot and protrusion cooperating to prevent the outer sleeve from sliding beyond the first open position, and the second slot and protrusion cooperating to prevent the outer sleeve from sliding beyond the second open position.

19. The pour spout of claim 17, wherein the air passage of the spout is in communication with ambient air to allow air to flow therethrough at a first air flow rate to facilitate flow of the fluid through the fluid passage at a first fluid flow rate when the outer sleeve is in the first open position, and, the air passage of the spout is in communication with ambient air to allow air to flow therethrough at a second air flow rate to facilitate flow of the fluid through the fluid passage at a second fluid flow rate when the Outer sleeve is in the second open position.

20. A pour spout for transferring fluid from a container to a vessel, the pour spout removably connectable to the container and comprising an inner sleeve having an air passage and a fluid passage, and an outer sleeve disposed around the inner sleeve and capable of sliding and rotating movement with respect to the inner sleeve, the inner and outer sleeves configured with a slot and protrusion arrangement, the outer sleeve capable of being rotated with respect to the inner sleeve to:

a locked position wherein the protrusion prevents the outer sleeve from being slid from a closed position, the closed position preventing fluid from flowing through the fluid passage; and an unlocked position wherein the slot and protrusion arrangement cooperate to allow the outer sleeve to be slid from the closed position to either one of a first open position and a second open position defined by the slot and protrusion arrangement.

21. The pour spout of claim 20, wherein the slot and protrusion arrangement define the first and second open positions by preventing the outer sleeve from sliding beyond the respective open position when a force is continuously applied to the outer sleeve sufficient to move the outer sleeve with respect to the inner sleeve.

22. A pour spout for transferring fluid from a container to a vessel, the pour spout comprising:

an inner sleeve; and, an outer sleeve, the outer sleeve being disposed around the inner sleeve and capable of sliding and rotating movement with respect to the inner sleeve, and wherein the inner and outer sleeves are configured with a slot and protrusion arrangement, the outer sleeve capable of being rotated with respect to the inner sleeve to a locked position wherein the protrusion prevents the outer sleeve from being slid from a closed position, and an unlocked position wherein the slot and protrusion arrangement cooperate to allow the outer sleeve to be slid from the closed position to an open position.

23. The pour spout of claim 22, wherein the slot and protrusion arrangement define the open position by preventing the outer sleeve from sliding beyond the open position when a force is continuously applied to the outer sleeve sufficient to move the outer sleeve with respect to the inner sleeve.

24. The pour spout of claim 22, wherein the slot and protrusion arrangement further defines a second open position.

25. The pour spout of claim 24, wherein the slot and protrusion arrangement comprises a first and a second slot in the outer sleeve, and a first and a second protrusion disposed on the inner sleeve, the first slot and protrusion cooperating to prevent the outer sleeve from sliding beyond the first open position, and the second slot and protrusion cooperating to prevent the outer sleeve from sliding beyond the second open position.

26. The pour spout of claim 22, further comprising an end cap disposed proximate a first end of the inner sleeve, wherein when the pour spout is in the closed position at least a portion of the end cap is biased against the outer sleeve by a biasing member.

27. The pour spout of claim 26, wherein the biasing member is a spring.

28. The pour spout of claim 26, wherein the biasing member is an elastomeric material.

29. The pour spout of claim 22, further comprising an air passage and a fluid passage disposed in the inner sleeve.

30. A pour spout for transferring fluid from a container to a vessel, the pour spout removably connectable to the container and comprising:

an inner sleeve having an end cap disposed proximate one end of the inner sleeve; and an outer sleeve disposed around the inner sleeve and capable of sliding and rotating movement with respect to the inner sleeve, the inner and outer sleeves configured with a slot and protrusion arrangement, the outer sleeve capable of being rotated with respect to the inner sleeve to a locked position wherein the protrusion prevents the outer sleeve from being slid from a closed position, wherein when the sleeve is in the closed position at least a portion of the end cap is biased against the outer sleeve by a biasing member, and an unlocked position wherein the slot and protrusion arrangement cooperate to allow the outer sleeve to be slid from the closed position to an open position defined by the slot and protrusion arrangement.

31. The pour spout of claim 30, further comprising an air passage and a fluid passage disposed in the inner sleeve.

32. The pour spout of claim 30, wherein the slot and protrusion arrangement define the open position by preventing the outer sleeve from sliding beyond the open position when a force is continuously applied to the outer sleeve sufficient to move the outer sleeve with respect to the inner sleeve.

33. The pour spout claim 30, wherein the slot and protrusion arrangement further defines a second open position.

34. The pour spout of claim 33, wherein the slot and protrusion arrangement comprises a first and a second slot in the outer sleeve, and a first and a second protrusion disposed on the inner sleeve, the first slot and protrusion cooperating to prevent the outer sleeve from sliding beyond the first open position, and the second slot and protrusion cooperating to prevent the outer sleeve from sliding beyond the second open position.

35. The pour spout of claim 30, wherein the biasing member is a spring.

36. The pour spout of claim 30, wherein the biasing member is an elastomeric material.

37. A pour spout for transferring fluid from a container to a vessel, the pour spout removably connectable to the container and comprising:

an inner sleeve having an air passage and a fluid passage disposed therein; and, an outer sleeve disposed around the inner sleeve and capable of sliding and rotating movement with respect to the inner sleeve, the inner and outer sleeves configured with a slot and protrusion arrangement, the outer sleeve capable of being rotated with respect to the inner sleeve to a locked position wherein the protrusion prevents the outer sleeve from being slid from a closed position and an unlocked position wherein the slot and protrusion arrangement cooperate to allow the outer sleeve to be slid from the closed position to an open position.

* * * * *